United States Patent [19]

Ikeda et al.

[11] Patent Number: 5,009,286

[45] Date of Patent: Apr. 23, 1991

[54] LUBRICATING OIL SUPPLYING MECHANISM IN SWASH PLATE TYPE COMPRESSOR

[75] Inventors: Hayato Ikeda; Masahiro Sawada; Norihiko Nakamura; Naoya Yokomachi, all of Kariya, Japan

[73] Assignee: Kabushiki Kaisha Toyoda Jidoshokki Seisakushi, Aichi, Japan

[21] Appl. No.: 445,409

[22] Filed: Dec. 4, 1989

[30] Foreign Application Priority Data

Dec. 2, 1988 [JP] Japan ..... 63-306370

[51] Int. Cl.[5] ..... F01M 1/00

[52] U.S. Cl. ..... 184/6.17; 417/269; 92/153

[58] Field of Search ..... 184/6.17; 92/71, 153; 60/456; 417/269, 271, 222, 222 S; 91/499

[56] References Cited

U.S. PATENT DOCUMENTS

| | | | |
|---|---|---|---|
| 3,749,523 | 7/1973 | Wahl, Jr. | 417/269 |
| 3,838,942 | 10/1974 | Pokorny | 417/269 |
| 4,108,577 | 8/1978 | Brucken et al. | 417/222 |
| 4,586,876 | 5/1986 | Kato et al. | 417/269 |
| 4,838,766 | 6/1989 | Kimura et al. | 417/222 S |

*Primary Examiner*—Ira S. Lazarus
*Assistant Examiner*—Alan B. Cariaso
*Attorney, Agent, or Firm*—Burgess, Ryan & Wayne

[57] ABSTRACT

A through hole in a cylinder block through which a bolt is inserted to assemble the cylinder block and the front and rear housings as one body, and is positioned above a horizontal plane on which a drive shaft lies, is utilized as a part of a passage for a lubricating oil so that a sufficient lubrication is supplied to a thrust bearing and other elements, and thus an effective mass production of a swash type compressor can be carried out because it becomes unnecessary to form an oil passage in the drive shaft, which passage is difficult to machine.

6 Claims, 5 Drawing Sheets

LUBRICATING OIL SUPPLYING MECHANISM IN SWASH PLATE TYPE COMPRESSOR

BACKGROUND OF THE INVENTION

1. Field of the Invention

The present invention relates to a mechanism for supplying a lubricating oil to bearings, etc. in a swash plate type compressor.

2. Description of the Related Art

The prior mechanism for supplying a lubricating oil to bearings, etc. in a swash plate type compressor is explained later in detail, with reference to an attached drawing.

In the prior mechanism, a passage for an lubricating oil must be formed in a drive shaft. The drive shaft, however, is formed of a very stiff material, because any distortion thereof at a high rotational speed must be prevented. Also the passage is long and has a small diameter, and accordingly, machining of the passage is difficult, for example, the drill bit is often broken during the machining, and removing burrs and washing the passage is also difficult. Therefore, a mass production of this passage is practically very difficult. Furthermore, it is difficult to reduce a diameter of the drive shaft while maintaining the strength thereof, because the passage for the lubricating oil is formed therein. Further, a required amount of the lubricating oil cannot be supplied to the upper portion of the compressor when the drive shaft is rotated at a low speed, i.e, less than 700 r.p.m., because the oil is fed from an outlet port on the drive shaft by centrifugal force.

SUMMARY OF THE INVENTION

An object of the present invention is to provide a lubricating oil supplying mechanism in a swash plate type compressor, which mechanism is easily machined and can be easily mass produced, and in which a passage for the lubricating oil is not formed in the drive shaft, and further, a required lubrication is obtained even at a low rotational speed.

In accordance with the present invention, there is provided a lubricating oil supplying mechanism in a swash plate type compressor having a drive shaft set in a substantially horizontal plane within the compressor, a swash plate fixed to the drive shaft, a cylinder block provided with a swash plate chamber for receiving the swash plate, front and rear housings closing both ends of the cylinder block, a plurality of bolts being passed through the cylinder block for fastening the front and rear housings and the cylinder block, radial bearings rotatably journaling the drive shaft, thrust bearings mounted between ends of a boss portion of the swash plate and the cylinder block, an oil reservoir for holding the lubricating oil, and a pump unit for supplying the lubricating oil to movable elements and positioned at one end of the drive shaft. The present invention is characterized in that a through hole in the cylinder block for inserting a bolt therethrough at a position above the plane on which the drive shaft lies is utilized as a part of a passage for the lubricating oil and is connected with an outlet portion of the passage, the outlet portion opening into the swash plate chamber for discharging the lubricating oil to lubricate the movable elements, the outlet portion is also positioned above the plane on which the drive shaft lies.

A lubricating oil drawn from the oil reservoir by the pump unit is fed into the swash plate chamber via the passage formed by the through hole for a bolt, formed in the cylinder block at a position above the plane on which the drive shaft lies. Namely, the through hole for a bolt is utilized at a part of a passage for the lubricating oil, and thus there is no need to form a passage in the drive shaft to allow the lubricating oil to travel toward the side of the unit far from the side at which the pump unit is positioned, whereby a required lubrication is carried out, even when the drive shaft is rotated at low speed, because the lubricating oil is fed from a position above the plane on which the drive shaft lies.

BRIEF DESCRIPTION OF THE DRAWINGS

The above objects, features and advantages of the present invention will become more apparent from the accompanying drawings, wherein.

DESCRIPTION OF THE PREFERRED EMBODIMENTS

Figure 7:
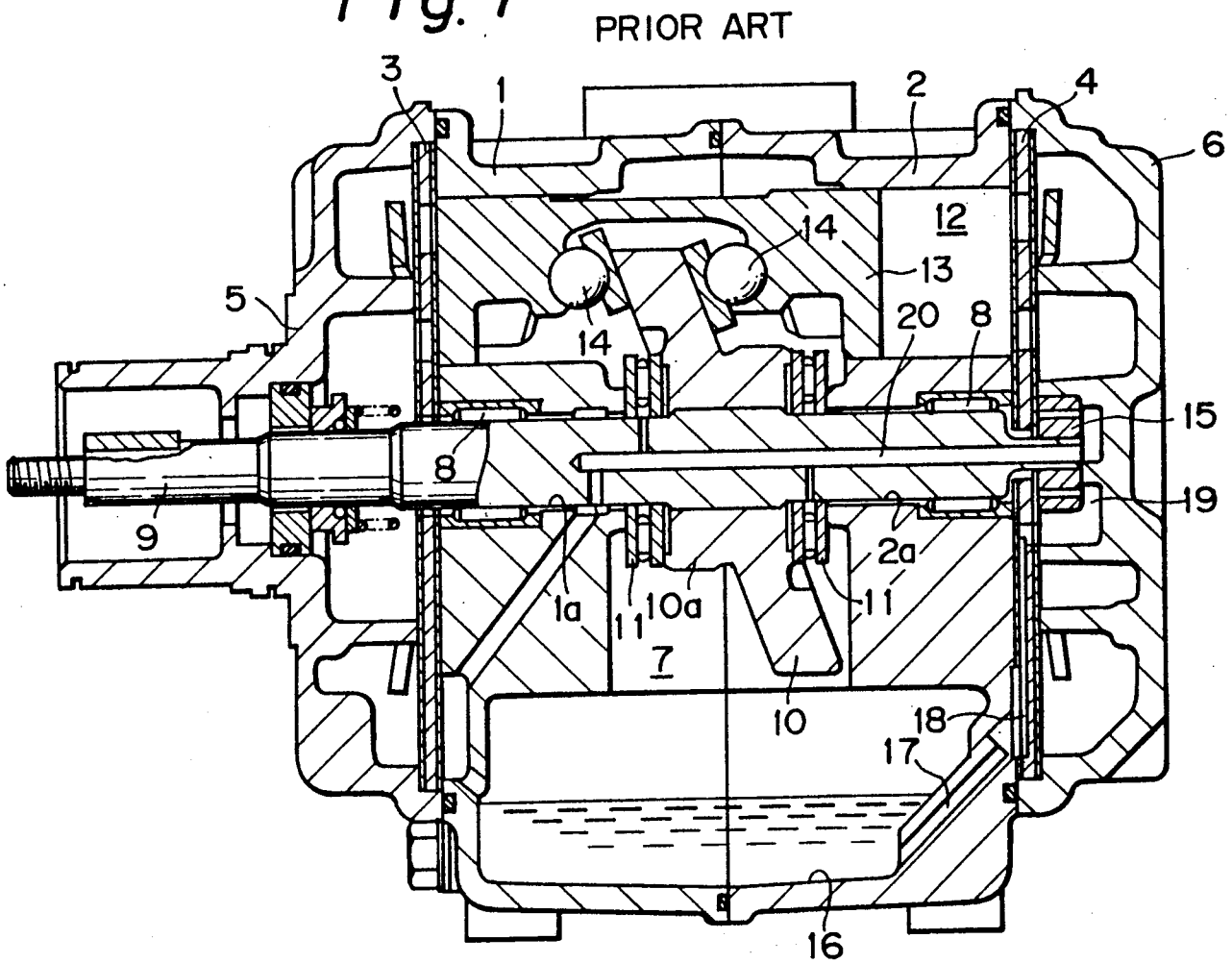
Fig. 7 PRIOR ART
FIG. 7 is a longitudinal cross sectional view of a swash plate type compressor of the prior art.

Referring to FIG. 7, a mechanism for supplying a lubricating oil to bearings, etc. in a swash plate type compressor of the prior art is described hereinafter. As shown in the figure, both ends of cylinder blocks 1 and 2 are covered by front and a rear housing 5, 6 with valve plates 3, 4 interposed therebetween, and these elements are fixed together as one body by a number of bolts passed through the cylinder blocks 1 and 2. A swash plate chamber 7 is formed at central portions of adjacent portions of the blocks 1 and 2, and a swash plate 10 is housed in the swash plate chamber 7 and fitted to a drive shaft 9 rotatably supported by radial bearings 8 in through holes 1*a* and 2*a* formed on a horizontal plane in a center of the cylinder blocks 1 and 2. Thrust bearings 11 are mounted between the cylinder blocks 1 and 2 and both ends of a boss portion 10*a* of the swash plate 10, and pistons 13 housed in the cylinder bores 12 are reciprocated in accordance with a rotation of the swash plate 10, through the medium of shoes 14.

A pump unit 15 is provided in the rear housing 6 and is driven by the drive shaft 9, to feed a lubricating oil in an oil reservoir 16, located under the substantially horizontal drive shaft 9, to the thrust bearings 11 and shoes 14, for lubrication thereof, by way of an oil pipe 17, a suction channel 18, a pump chamber 19, and an oil passage 20 formed in the drive shaft 9. This oil supply mechanism is disclosed, for example, in Japan Unexamined Utility Model Publication (Kokai) No. 59-107074.

This prior art mechanism for supplying lubricating oil in the compressor has several problems, as mentioned before, and the present invention is intended to solve these problems.

Figure 1:
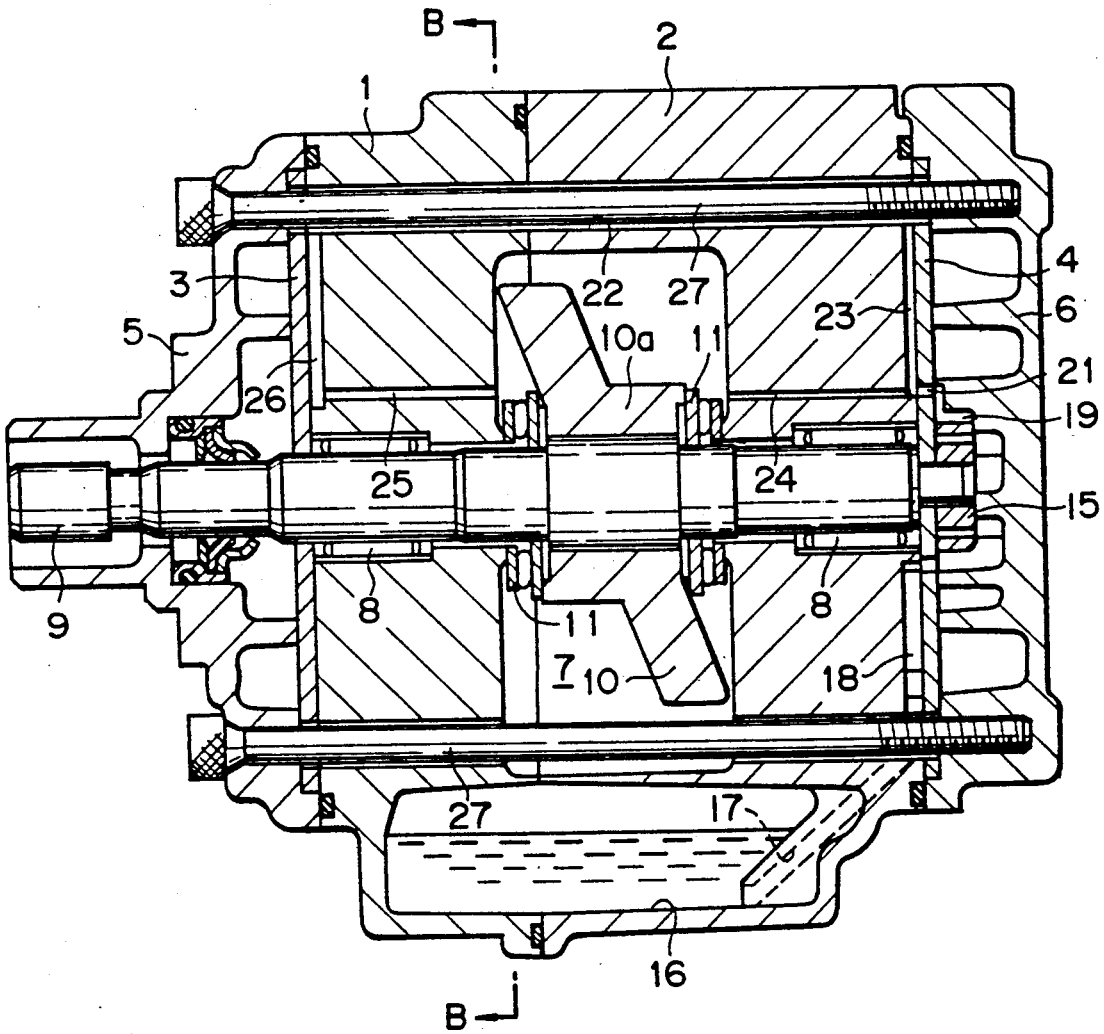
FIG. 1 is a longitudinal cross sectional view, taken along the line A—A of FIG. 2, of a swash plate type compressor to which the present invention is applied, as a first embodiment thereof.
Figure 2:
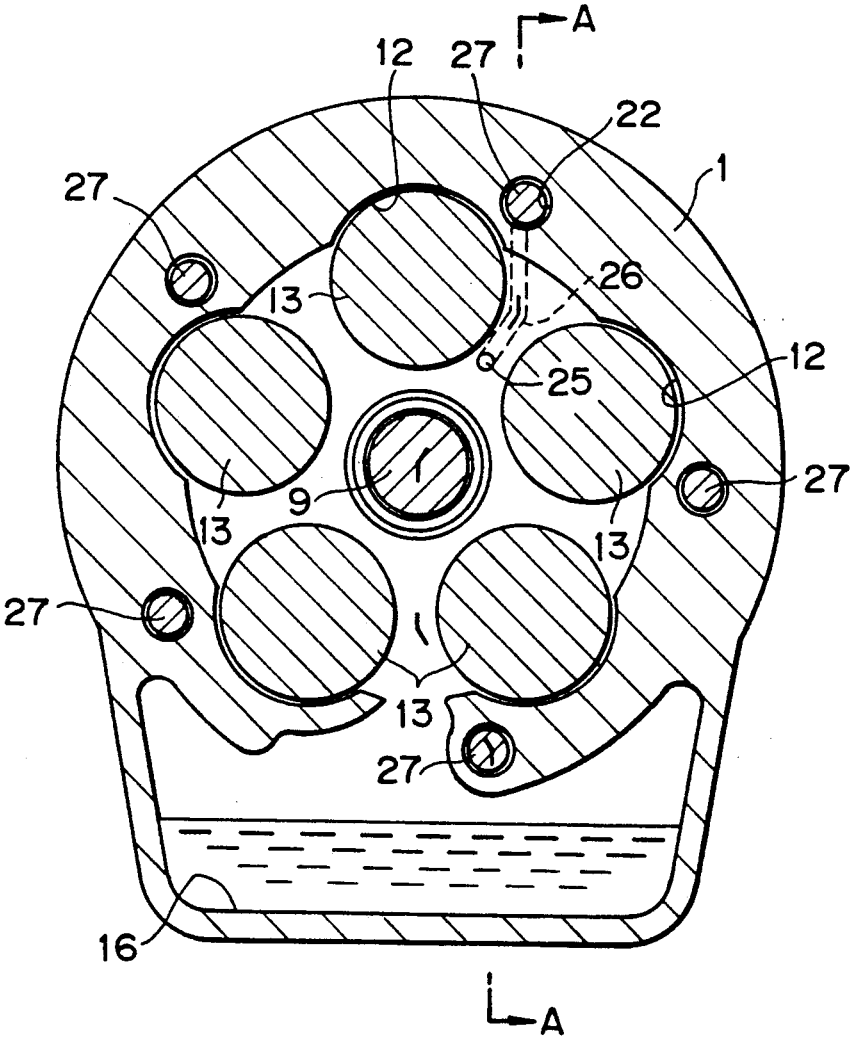
FIG. 2 is a cross sectional view taken along the line B—B of FIG. 1.

The first embodiment according to the present invention is explained hereinafter with reference to FIGS. 1 and 2. As shown in the FIG. 1, a hole 21 is formed through the rear valve plate 4 in a position corresponding to an upper portion of the pump chamber 19, and a vertical channel 23 is formed at an end of the cylinder block 2 facing the rear housing 6, one end of the vertical channel 23 being connected with a through hole 22 for a bolt positioned above the plane on which the drive shaft 9 lies, and the other end of the channel 23 being connected with the hole 21. An outlet passage 24, as a part of the passage for the lubricating oil, is formed in the cylinder block 2 in parallel with the drive shaft 9, and has one end opening into position above the thrust bearing 11 in the swash plate chamber 10 and another end connected with the channel 23. Another outlet passage 25, as a part of the passage for lubricating oil, is formed in the cylinder block 1 at a position corresponding to the outlet portion 24, and a vertical channel 26 is formed at an end of the cylinder block 1 facing the front housing 5; one end of the vertical channel 26 being connected with the through hole 22 and the other end thereof being connected with the outlet portion 25.

Accordingly, passage for the lubricating oil is formed by the hole 21, the through hole 22, the vertical channels 23 and 26, and the outlet portions 24 and 25, to transfer oil therethrough that is drawn from the oil reservoir 16 by the pump unit 15. The feature of the present invention is that the through hole 22 for a bolt 27 is utilized as a part of the passage for the lubricating oil, to transfer the oil therethrough from the rear of the compressor to the front thereof, and thus there is no need to form a passage in the drive shaft 9, which passage is difficult to machine. Therefore, the time needed for machining the oil passage in the compressor is greatly reduced, and thus an effective mass production of the compressor becomes possible.

When the pump unit 15 is operated by the rotation of the drive shaft 9, the lubricating oil is drawn from the oil reservoir 16 into the pump chamber 19, and is fed to the thrust bearings 11 at the rear of the compressor via the hole 21, the channel 23, and the outlet portion 24, and to the thrust bearings 11 at the front of the compressor via the hole 21, the channel 23, the through hole 22, the channel 26, and the outlet portion 25. The outlet portion 24 near the pump chamber 19 is narrower than the outlet portion 25 at the front of the compressor, to ensure that sufficient lubricating oil is fed to the outlet portion 25, due to the oil flow path resistance of the narrower outlet portion 24. Further, the lubricating oil is fed through the oil passage 20 (FIG. 7) formed in the drive shaft 9 of the prior art, and therefore, an upper portion of the thrust bearings 11 is not always sufficiently lubricated when the rotational speed of the drive shaft 9 is less than 700 r.p.m. In the present invention, however, the lubricating oil is fed to the thrust bearing 11 from an outlet above the bearing 11, and thus a sufficient lubrication of the bearing 11 is obtained even when the drive shaft 9 is rotated at 400 r.p.m., as in, for example, an idling state.

Figure 3:
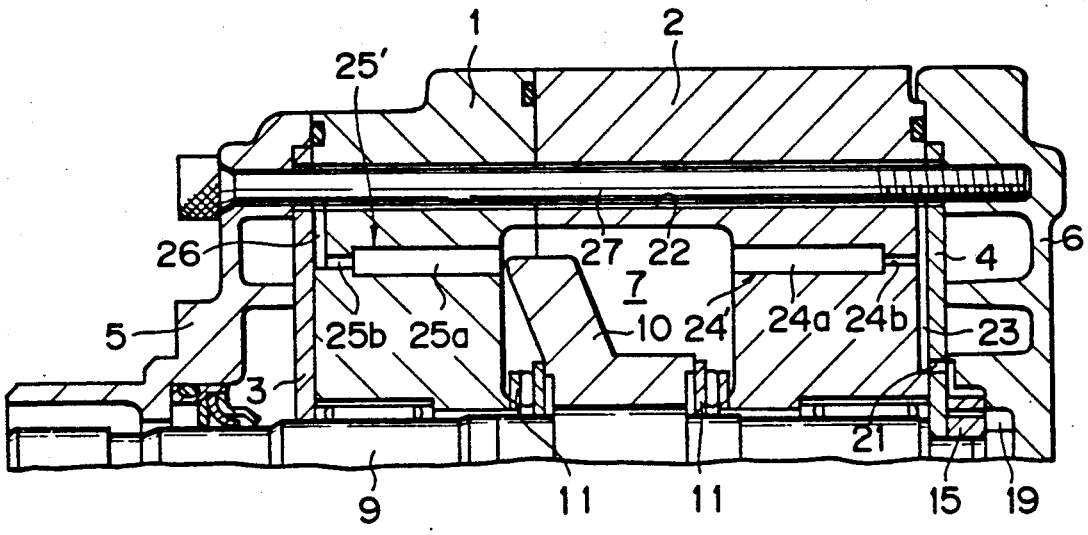
FIG. 3 is a partial and longitudinal cross sectional view of a swash plate type compressor showing a second embodiment of the present invention.

The second embodiment of the present invention is now explained with reference to FIG. 3. In this embodiment, the outlet portions 24', 25' of a passage for the lubricating oil are located at as high a position as possible in the side walls defining the swash plate chamber 7, and each of these portions 24', 25' is formed by two portions 24*a* and 24*b* or 25*a* and 25*b*. Namely, an outlet portion 25' at the front of the compressor is constructed by one portion 25*a* having a large diameter and another portion 25*b* having a small diameter, and an outlet portion 24' at the rear of the compressor is constructed by one portion 24*a* having a large diameter and another portion 24*b* having a small diameter, to facilitate the machining of these outlets. The diameter of the portion 24*b* at the rear of the compressor is smaller than the diameter of the portion 25*b* at the front of the compressor, and therefore, a sufficient flow of the lubricating oil through the outlet portion 25' is ensured. Furthermore, the lubricating oil is easily supplied to shoes 14 (FIG. 7) because the oil is discharged from the upper portion of the chamber 7.

Figure 4:
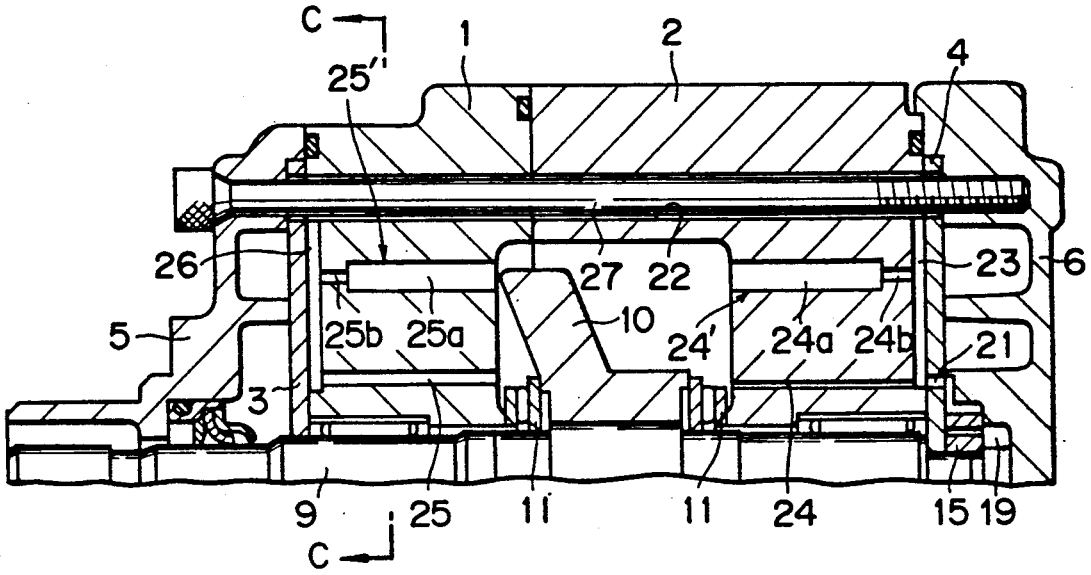
FIG. 4 is a partial and longitudinal cross sectional view of a swash plate type compressor showing a third embodiment of the present invention.
Figure 5:
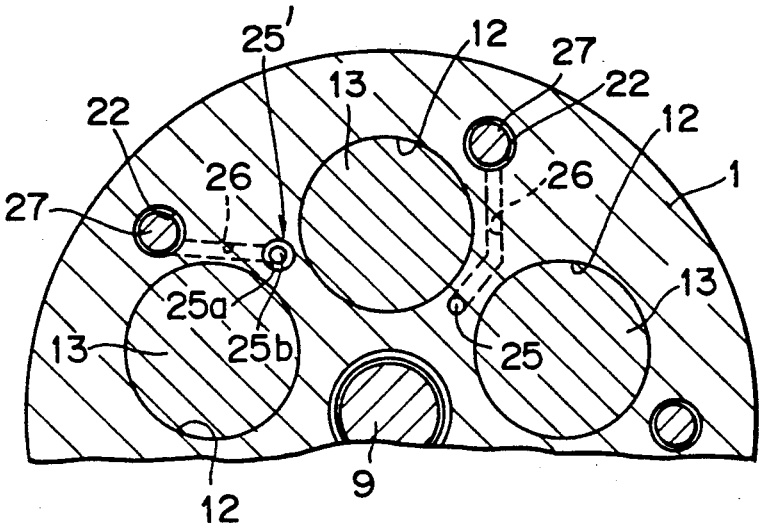
FIG. 5 is a partial and cross sectional view taken along the line C—C of FIG. 4.

The third embodiment of the present invention is explained with reference to FIGS. 4 and 5. In this embodiment, two kinds of outlets 24 and 24' or 25 and 25' are provided at the rear or at the front of the compressor. The outlets 24 and 25 are the same as the outlets of the first embodiment, and the outlets 24' and 25' are the same as the outlets in the second embodiment. The outlets 25, 25*a* (or 24, 24*a*) can be arranged between two different cylinder bores 12, respectively, as shown in FIG. 5. Furthermore, the outlets 24 and 25 (or 24' and 25') need not face each other.

Figure 6:
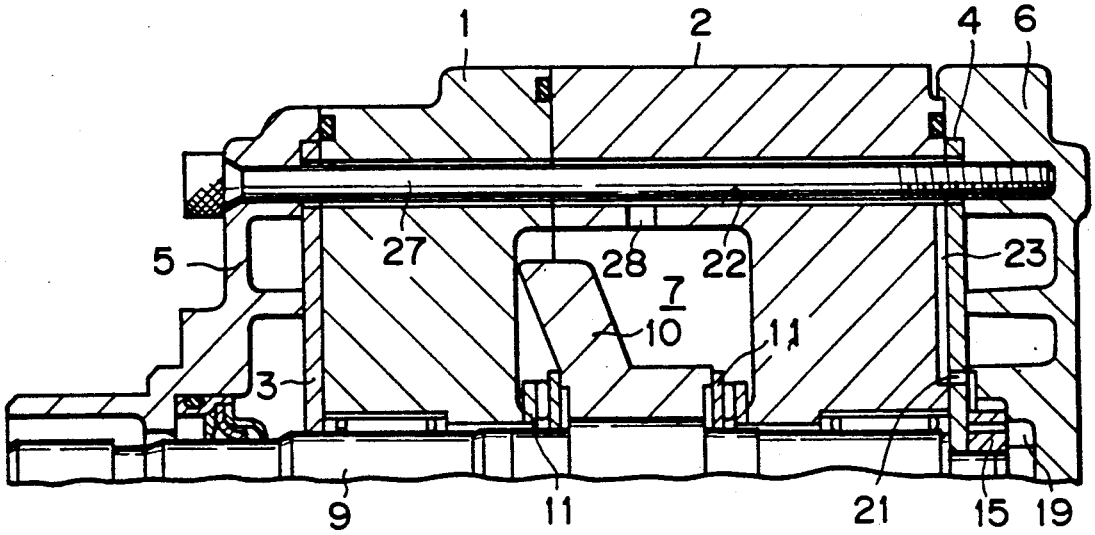
FIG. 6 is a partial and longitudinal cross sectional view of a swash plate type compressor showing a fourth embodiment of the present invention.

The fourth embodiment of the present invention is explained with reference to FIG. 6. In this embodiment, an outlet 28 of a passage for the lubricating oil is formed in the top wall defining the swash plate chamber 7. Namely, the outlet portion 28 is directly connected with the through hole 22. In this case, the lubricating oil is supplied into the swash plate chamber 7 through the one outlet 28. The outlet portion 28 may be positioned off center of the top wall. Furthermore, the outlets 25 or 25' (or 24 or 24') in the first or the second embodiment may be formed in the cylinder blocks 1, 2 together with the outlet 28.

From the above description of the preferred embodiments of the present invention, it will be understood that, according to the present invention, it is not necessary to form a difficult-to-machine oil passage in the drive shaft as a through hole for a bolt used when assembly a swash plate type compressor is utilized as a part of a passage for supplying the lubricating oil. Namely, the time required for drilling the passage, removing burrs from the passage, and washing the passage to remove chips therein is reduced, and therefore, an effective mass production of the compressor can be carried out. Furthermore, the size of the drive shaft can be reduced, and thus, the size of the compressor can be reduced, because the strength of the drive shaft is maintained even when the size thereof is reduced. Further, the drawback of an insufficient lubrication as in the prior, at a rotational speed of less than 700 r.p.m., is avoided by the present invention, even when the drive shaft is rotated at 400 r.p.m.

We claim:

1. Lubricating oil supplying mechanism in a swash plate type compressor having a drive shaft set in a substantially horizontal plane, a swash plate fixed to the drive shaft, a cylinder block provided with a swash plate chamber receiving the swash plate, front and rear housings closing both ends of the cylinder block, a plurality of bolts arranged in through holes in the cylinder block for fastening the front and rear housings and the cylinder block, radial bearings rotatably journaling the drive shaft, trust bearings mounted between ends of a boss portion of the swash plate and the cylinder block, an oil reservoir holding the lubricating oil, and a pump unit for supplying the lubricating oil to movable elements, the pump unit being positioned at one end of the drive shaft, characterized in that at least one through hole of said cylinder block in which one of said plurality of bolts is arranged, which through hole is positioned above the horizontal plane on which the drive shaft lies is connected with a channel formed in said cylinder block from said pump unit to said through hole and with an outlet portions of a passage of said lubricating oil, the outlet portion opening into said swash plate chamber for discharging said lubricating oil to lubricate said movable elements, the outlet portion being positioned above the horizontal plane on which said drive shaft lies.

2. Lubricating oil supplying mechanism in a swash plate type compressor according to claim 1, wherein one of said movable elements includes said thrust bearings.

3. Lubricating oil supplying mechanism in a swash plate type compressor according to claim 1, wherein said outlet portion of said passage is positioned above said thrust bearings.

4. Lubricating oil supplying mechanism in a swash plate type compressor according to claim 3, wherein said outlet portion of said passage is provided at two positions on said cylinder block, one outlet portion being positioned near said pump unit in a line of said passage, and the other outlet being positioned far from said pump unit in a line of said passage, and wherein said one outlet portion is narrower than said other outlet.

5. Lubricating oil supplying mechanism in a swash plate type compressor according to claim 3, wherein said outlet portion of said passage is provided in said cylinder block in parallel with a plane on which said drive shaft lies, one half of said outlet portion having a larger radius than the other half thereof.

6. Lubricating oil supplying mechanism in a swash plate type compressor according to claim 3, wherein said outlet portion of said passage is directly connected to said through hole and opens into said swash plate chamber at a top face thereof.

* * * * *